United States Patent [19]

Hall

[11] 4,169,592

[45] Oct. 2, 1979

[54] ELECTRONIC REFLEX GAME

[76] Inventor: David J. Hall, 18104 Lovell Rd., Spring Lake, Mich. 49456

[21] Appl. No.: 770,667

[22] Filed: Feb. 22, 1977

[51] Int. Cl.[2] ..... A63F 9/06; A61B 5/16

[52] U.S. Cl. ..... 273/1 E; 35/22 R; 128/745; 128/782

[58] Field of Search ..... 273/1 E, 130 AB, 138 A; 35/22 R; 128/2 N, 2 R

[56] References Cited

U.S. PATENT DOCUMENTS

| | | | |
|---|---|---|---|
| 2,678,692 | 5/1954 | Ranseen | 35/22 R X |
| 2,984,017 | 5/1961 | Pask | 35/22 R X |
| 3,024,020 | 3/1962 | Alton | 273/1 E X |
| 3,653,026 | 3/1972 | Hurley | 273/138 A X |
| 3,698,385 | 10/1972 | Low et al. | 273/1 E X |
| 3,933,354 | 1/1976 | Goldfarb et al. | 273/1 E |

*Primary Examiner*—Paul E. Shapiro
*Attorney, Agent, or Firm*—John E. McGarry

[57] ABSTRACT

An electronic reflex game wherein one of a plurality of switches is manipulated by a player to deactuate one of a plurality of light bulbs. An actuation device randomly actuates one of three light bulbs. Three corresponding switches are situated below the lights wherein each switch deactuates the light above it. The actuation device includes a variable frequency oscillator which generates pulses to trigger one of three lights. The variable frequency oscillator also determines the amount of time within which the switches can deactuate the lights. Each time a correct switch is pressed during a limited time period, a counter indicates the correct hit and a new light is actuated at random. A timing device gradually increases the frequency of the variable frequency oscillator as the game progresses so the time period when a switch can deactuate the light gradually shortens as the game progresses. The random actuation of lighting continues until a light is not deactuated within the limited time period or when two switches are pressed simultaneously during the limited time period.

19 Claims, 2 Drawing Figures

ELECTRONIC REFLEX GAME

BACKGROUND OF THE INVENTION

1. Field of the Invention

This invention relates to amusement devices and, more particularly, an amusement device for testing eye and hand reflex and coordination.

2. Description of the Prior Art

Many commercial amusement devices involve the use of stimuli and a means to respond to the stimuli by pressing a button or manipulating a correct switch. One such device is disclosed in the U.S. Pat. No. 3,933,354 issued to Goldfarb et al on Jan. 20, 1976. Goldfarb et al discloses a karate reflex game wherein lights are illuminated at various positions on a picture of a body. The lights are illuminated in a pseudo-random or random order. The participants strike the lighted portion of the picture wherein a switch means extinguishes the light. Extinguishment of the light coincides with the illumination of a second light wherein the participant knocks the second light out and a subsequent light is illuminated. At the end of a certain time period, the game is shut off and a score is determined. The game can be adapted to allow two people to play against each other.

The U.S. Pat. No. 2,491,888 issued to Baker on Dec. 20, 1949 discloses an electric game wherein a plurality of people may play. Each person has a stop button and a block of three lamps located on a game board. Each lamp is illuminated for a short period of time at random. When one light is extinguished, a second lamp lights up. The first person to correctly press his stop button while one of his lamps is illuminated either wins the game or receives a certain number of points.

The U.S. Pat. No. 1,857,629, issued to Epstein et al on May 10, 1932 discloses a device similar to the one disclosed in Baker. Each person has a plunger. A person takes his turn to try to press his plunger when one of his lights is illuminated. If one person misses, the next person takes his turn. The first person to correctly time the pressing of his plunger with the illumination of one of his lights wins the game.

SUMMARY OF THE INVENTION

According to the invention, a game has a plurality of stimuli indicators and an electrical circuit including means for sequentially actuating the stimuli indicators at random. A corresponding number of manually operable switch means are coupled with the stimuli indicators and means in the electrical circuit for electrically deactuating a stimuli indicator when a corresponding switch means is operated.

Desirably, the electrical circuit includes a means for disabling at least a portion of the electrical circuit for ending the game played with the apparatus in the event that the stimuli indicator remains actuated at the end of a predetermined period of time.

In one embodiment, there is also included a manually operative means for resetting the disabling means and for restarting the game apparatus. Preferably, if the switch means is not operated within the predetermined period of time, a means for indicating the lateness of the operation of the switch means provides a first signal. Typically, the means for indicating the lateness of the operation is a light.

In one embodiment, the disabling means is coupled to the late indicating means to prevent the late indicating means to operate more than once prior to operation of the resetting means.

If the switch means is properly operated within the predetermined time period of time, the actuated stimuli indicator is deactuated and the means for actuating one of the stimuli indicators actuates another stimuli indicator at random.

It is desirable that the switch means is coupled to the disabling means for actuating the disabling means when two or more switch means are simultaneously operated to avoid cheating. It is also desirable that means coupled to the switch means provide a second signal, typically a light labeled "cheat" when two or more switch means are simultaneously operated.

In one embodiment, the means for actuating at random one of the stimuli indicators includes a short pulse generator means, typically an oscillator. A means, typically a counter-divider receives the pulses and sequentially applies them to one of a plurality of gating means. The gating means in turn are operably connected to a corresponding stimuli indicator. Means for generating a timing pulse generates a pulse of a sufficient length to coincide simultaneously with a pulse being delivered by the counter-divider to one of the gating means. The means for generating a timing pulse is operably connected to the gating means. The particular gating means which actuates a corresponding indicator is the one simultaneously receiving the pulses from both the counter-divider and means for generating the timing pulse. Typically a variable frequency oscillator generates a pulse of a predetermined length and is operably connected to a monostable multivibrator which generates the timing pulse at the beginning of the pulse from the variable frequency oscillator. The initial pulses from the variable frequency oscillator and the pulses from the first oscillator which are received by the counter-divider bear no synchronization with one another so that the plurality of stimuli indicators are actuated in random fashion. Preferably, a means for preventing an actuation of a second stimuli indicator when another stimuli indicator is actuated is included in the circuit.

In one embodiment, the disabling means includes a means for generating a pulse of predetermined length. Typically, means for generating the pulse of predetermined length is the variable frequency oscillator. The generating means is coupled to a means for generating an error check pulse after the beginning of the pulse of predetermined length but before the start of the next pulse of predetermined length. Preferably, the error check pulse is generated shortly after the end of the pulse of predetermined length from the variable frequency oscillator. The error check pulse generating means is coupled to the late indicating means and disabling means for the error check pulse to actuate the late indicating means and the disabling means if the stimuli indicator remains actuated simultaneous to the actuation of the error check pulse.

Preferably, means for shortening the time period of successive pulses from the generating means for generating pulses of predetermined length is included in the circuit. Preferably, an input voltage is connected to the variable frequency oscillator wherein the variable frequency oscillator has its frequency dependent on the input voltage. Thusly, the time period between the beginning of the pulse which triggers the timing pulse that actuates the stimuli indicator and the generation of the error check pulse after the end of the pulse is shortened.

The input voltage is coupled to a means for gradually changing the input voltage. Typically, the means for gradually changing the voltage to the variable frequency oscillator includes a charged capacitor and means for slowly discharging the capacitor.

Preferably, when the disabling means is actuated, a means for recharging the capacitor is actuated so the capacitor is recharged before the restart of the next successive game. The recharging means is deactuated upon operation of the resetting means.

In one embodiment, the stimuli indicators are three lights.

Preferably, the switch means are spring biased buttons normally in an open position and pushed to a closed position. The closing of the correct button will extinguish the corresponding stimuli indicator light.

In one embodiment, a means for counting the successive number of times the stimuli indicators are deactuated by the corresponding switch means before the disabling means disables a portion of the electrical circuit is operably connected to the circuit.

In one embodiment, the game has means for randomly blinking the stimuli lights when in a standby mode to attract people to play the game.

BRIEF DESCRIPTION OF THE DRAWINGS

The invention will now be described with reference to the accompanying drawings in which.

DETAILED DESCRIPTION OF THE PREFERRED EMBODIMENT

Figure 1:
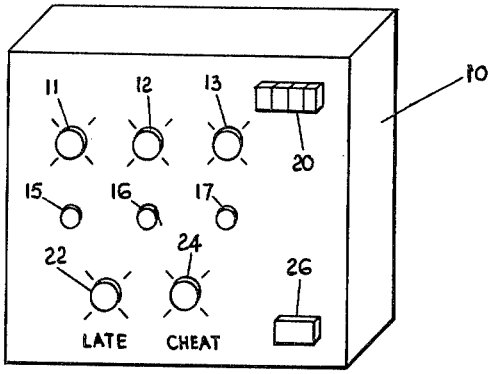
FIG. 1 is a front perspective view of an embodiment of the invention.

Referring particularly to FIG. 1, an illustration of the exterior appearance of the game apparatus is shown. Three stimuli indicator lights 11, 12, and 13 are mounted within an upper portion of a box structure 10. Below the lights 11, 12, and 13 are corresponding switch means in the form of push buttons 15, 16, and 17. Push button 15 is vertically aligned below the light 11. Push button 16 is vertically aligned below the light 12. Push button 17 is vertically aligned below the light 13. In the upper righthand corner of the box 10 is a counter 20. At the lower portion of the box are two lights 22 and 24. Light 22 is labeled a late light and light 24 is labeled a cheat light. At the lower righthand corner of the box 10 is a start switch 26. The start switch 26 can be designed to take coins before the game apparatus is operable.

The box 10 can be any desired design and size and the lights, buttons, counter, and start switch can be arranged in alternative patterns.

In operation, the game is connected to a power source (not shown). A six volt battery, battery pack, or an AC outlet coupled with a DC transformer are appropriate sources. A player actuates the start button 26 which starts the game and resets the counter 20. One of the lights 11, 12, or 13 is lit at random and the player must press the corresponding button 15, 16, or 17 to extinguish the light. After the first light is extinguished, a subsequent light is lit at random and the player then presses the corresponding button to the newly lit light. Each time a player correctly presses the corresponding button 15, 16, or 17 for the actuated light 11, 12, or 13, the counter 20 indicates a certain score.

However, the game, while it starts out at a leisurely pace, starts to progress at a more rapid pace each time a player correctly presses the corresponding button within the given time. The time period when the button 15, 16, or 17 must be pressed to extinguish each successive corresponding light is shortened. The time period for illustration can be one second long and gradually shortened to a third of a second after thirty seconds of playing time. At the time when the player can no longer press the corresponding button 15, 16, or 17 within the limited time period, a late light 22 is actuated and the game ends. Counter 20 indicates the final score.

If a player presses two or more buttons simultaneously, the cheat light 24 is actuated and the game also ends with the score indicated by counter 20.

Once the game ends, the game apparatus attains a disabled mode wherein the lights 11, 12, and 13 are randomly actuated and deactuated to attract other players.

Figure 2:
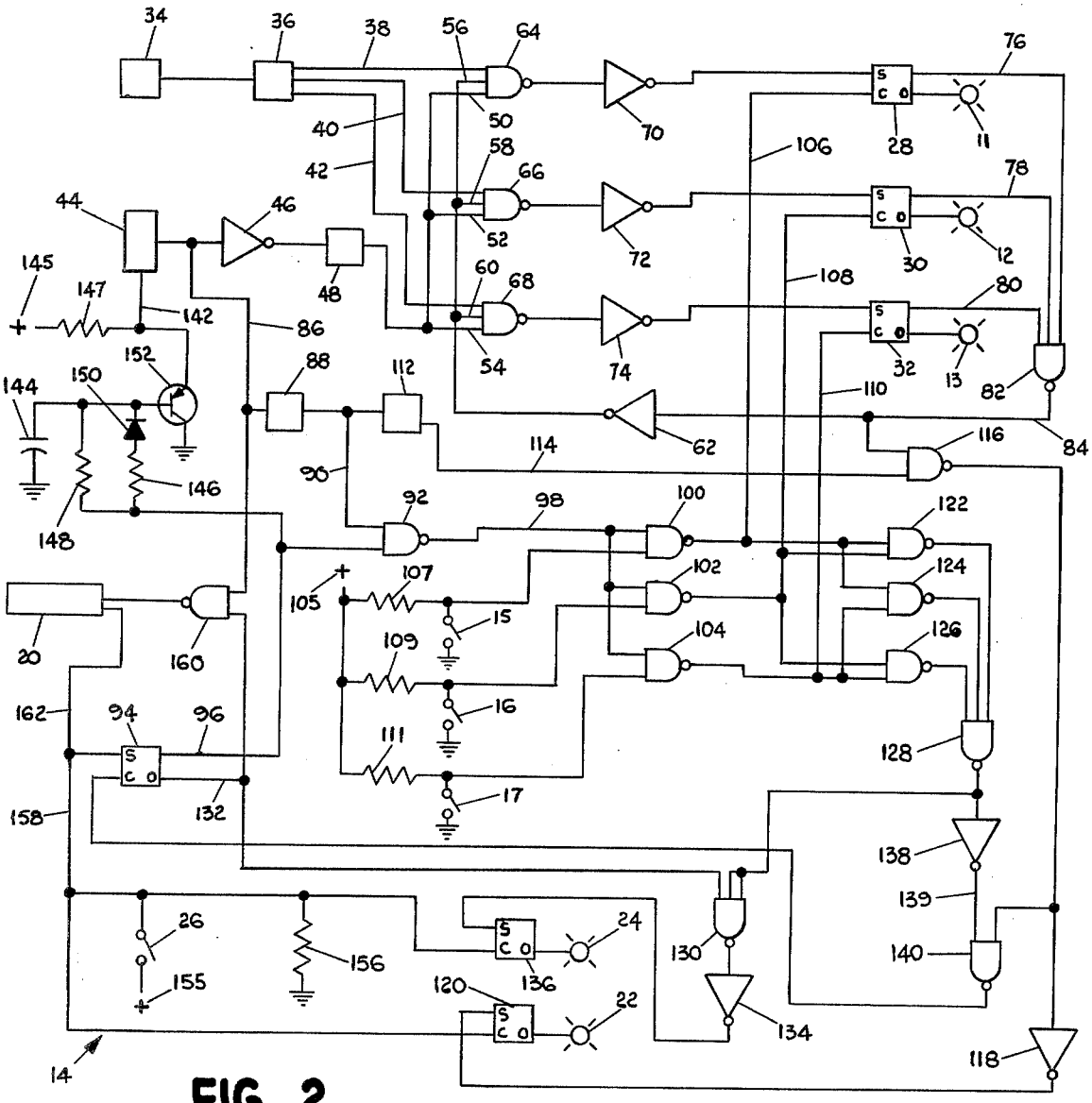
FIG. 2 is a schematic representation of the logic circuitry for one embodiment of the present invention.

To better understand the operation of the game, reference will now be made to FIG. 2. FIG. 2 schematically illustrates an electrical circuit 14 which is used to operate the game apparatus shown in FIG. 1. This circuit can be manufactured from readily available electrical components.

In electrical circuit 14, the means for actuating the stimuli indicator lights 11, 12, and 13 includes lights 11, 12, and 13 operably connected to the outputs of flip-flops 28, 30, and 32 respectfully. The flip-flops 28, 30, and 32 receive a set of impulses which in part originates from an oscillator 34. The oscillator 34 generates at least one hundred rapid pulses a second. The rapid pulses are applied to a decade counter-divider 36 which distributes the pulses in sequence through ten output contacts. Line 38 is connected to the third contact, line 40 is connected to the sixth contact, the line 42 is connected to the tenth contact. For purposes of simplicity, the remaining contacts of the counter-divider are not shown. The three lines 38, 40, and 42 are each connected to the input side of NAND gates 64, 66, and 68 respectively. The output leads of NAND gates 64, 66, and 68 are connected to inverters 70, 72, and 74 respectively. The NAND gates 64, 66, and 68, and inverters 70, 72, and 74 act as a gating means responsive to the simultaneous reception of three pulses. The output of the inverters 70, 72, and 74 are connected to the set input of flip-flops 28, 30, and 32 respectively.

A variable frequency oscillator 44 is operably connected to flip-flops 28, 30, and 32. It also is the other element which generates the impulse to one of the set inputs of flip-flops 28, 30, and 32. The oscillator 44 applies a pulse to an inverter 46 which inverts the signal and applies the inverted signal to a monostable multivibrator 48. Since the monostable multivibrators used in this circuit sense the end of any input pulse, the inverter 46 causes the multivibrator 48 to sense the beginning of the pulse from the oscillator 44. The multivibrator immediately applies a short timing pulse to three leads 50, 52, and 54 which are connected to the input side of NAND gates 64, 66, and 68 respectively. The timing pulse generated from multivibrator 48 and applied to leads 50, 52, and 54 is long enough to allow the counter-divider 36 to apply a rapid pulse to one of lines 38, 40, or 42 simultaneously with the timing pulse from multivibrator 48. The gating means receiving the two pulses simultaneously will generate a pulse to the respective flip-flops 28, 30, and 32 to actuate the respective light.

As can be seen, the decade divider 36 controls which light will be actuated while the monostable multivibrator 48 controls the time at which the light is actuated.

The means for preventing a second indicator to be actuated when the first indicator is on includes the flip-flops 28, 30, and 32 having their complementary outputs connected to a NAND gate 82. The output 84 of NAND gate 82 is connected to an inverter 62. The inverter has its output connected to the input leads 56, 58, and 60 of NAND gates 64, 66, and 68 respectively.

The NAND gate 82 and inverter 62 prevent a second light from lighting while a first light remains actuated since the output from inverter 62 will be zero and respective inputs leads 56, 58, and 60 will carry no pulse if any of the lights are on.

The disabling means which is actuated if a stimuli indicator remains actuated after a predetermined period of time includes the variable frequency oscillator 44 having a lead 86 operably connected to the input of a second monostable multivibrator 88. The output of multivibrator 88 is connected to a third monostable multivibrator 112. The output 114 of the multivibrator 112 is connected to the input of a NAND gate 116. The NAND gate 116 has a second input which is connected to the output 84 of NAND gate 82. The output of NAND gate 116 is connected to an input of NAND gate 140 which has its second input 139 normally with a positive potential. NAND gate 140 has its output connected to the clear input of flip-flop 94.

The disabling means is actuated if a light 11, 12, or 13 remains actuated after a predetermined period of time. The end of the pulse of predetermined length from the variable frequency oscillator 44 actuates multivibrator 88 to apply a short pulse which, upon termination, actuates multivibrator 112 to generate an error check pulse. The error check pulse is generated before the start of the next pulse from variable frequency oscillator 44. If any of the actuated lights 11, 12, or 13 remains actuated when the error pulse is generated, the NAND gate 116 will receive pulse simultaneously on both its inputs and thus will not generate a pulse to the NAND gate 140. The NAND gate 140 will then respond to the lack of a pulse from NAND gate 116 and generate a pulse to be applied to the clear input of flip-flop 94.

The disabling means is operably coupled to the late indicating means 116. The output of NAND gate 116 is connected to an inverter 118 which in turn has its output connected to a set input of flip-flop 120. The output of flip-flop 120 is connected to the late light 22.

The disabling means is also operably connected to the counter 20. The output 132 of the flip-flop 94 is operably connected to NAND gate 160 which has its output connected to the counter 20. When flip-flop 94 is cleared, lead 132 becomes deactuated and carries no pulse. NAND gate 160, responsive to the lack of a pulse, will carry a continuous pulse to counter 20. Counter 20, being responsive to fluxes in the output of NAND gate 160 will stop counting. If any of the lights 11, 12, or 13 remains actuated when the error check pulse is generated, NAND gate 116 will not generate a pulse to inverter 118. The inverter 118 will in turn generate a pulse to set the flip-flop 120 so the late light 22 is actuated and remains actuated.

Each button 15, 16, and 17 is spring biased in the open position and is closed by pressure exerted on it. Each button is grounded and is operably connected to a positive potential 105 and one of the resistors 107, 109, and 111. Positive potential 105 can be obtained from a six volt battery or battery pack. Resistors 107, 109, and 111 can each have a resistance of 1000 ohms.

Each of the outputs of NAND gates 100, 102, and 104 are connected to the respective clear inputs 106, 108, and 110 of flip-flops 28, 30, and 32 respectively.

If the correct button 15, 16, and 17 is pressed before the error check pulse is generated, the button grounds the potential of the input to the respective NAND gate 100, 102, and 104 and the respective NAND gate will generate a pulse to the clear input of the respective flip-flops 28, 30, or 32. The clear input will extinguish the respective light 11, 12, or 13. In turn, NAND gate 82 will not generate a pulse along line 84 which in turn causes NAND gate 116 to generate a pulse to inverter 118 which will therefore generate no pulse to the set input of flip-flop 120, therefore avoiding actuation of the late light 22. Also the output of NAND gate 140 receives the pulse from NAND gate 116 so that when lead 139 is normally actuated, the output of NAND gate 140 will not send out a pulse to the clear input of flip-flop 94 to allow the counter 20 to continue to count and the circuit 14 to continue in a play mode.

The circuit has means for shortening the time period of successive pulses from the generating means for generating a pulse of predetermined length to provide for a continually greater challenge in the game. The variable frequency oscillator 44 has its frequency dependent upon the voltage of pin 142. The pin 142 is operably connected to resistor 147 which in turn is connected to a positive potential 145. The positive potential 145 can be obtained from a six volt battery or battery pack. The emitter of a PNP transistor 152 which acts as a variable resistor is connected to the pin 142. The collector of transistor 152 is grounded. The base of transistor 152 is connected to a positive side of a grounded capacitor 144 which in turn is operably connected to complementary output 96 of flip-flop 94. The complementary output 96 of flip-flop 94 and capacitor 144 have a high ohm resistor 148, such as 100 K ohms, connected therebetween. In parallel with a high ohm resistor 148 is a series connected resistor 146 with a lower resistance which can be 1000 ohms and a diode 150 positioned to allow current to flow to the capacitor 144.

If the operator correctly pushes one of the buttons 15, 16, or 17 to extinguish the corresponding light, the variable frequency oscillator 44 will generate the second pulse but at a higher frequency. The capacitor 144 has been slightly discharged, decreasing the resistance of transistor 152 which in turn decreases the voltage along pin 142, controlling the frequency of the variable frequency oscillator 44. A successive light 11, 12, and 13 is again randomly actuated and the procedure is repeated but at a quicker pace than previously.

The counting means registers how many lights were correctly extinguished in a game. A NAND gate 160 has two inputs connected to lines 86 and output 132 of flip-flop 94. The NAND gate 160 has its output connected to the counter 20. The counter 20 will register a correct "hit" because the beginning of the next pulse from the variable frequency oscillator 44 will be received by NAND gate 160 which has its second input connected to the output of flip-flop 94 which generates a pulse when the game is in a play mode. As such, NAND gate 160 will apply an output pulse to the counter every time the variable frequency oscillator 44 ends its pulse when the game is in a play mode. Every time the counter 20 receives a beginning of the pulse from NAND gate 160, it registers a score.

To prevent a person from cheating and pushing two buttons simultaneously, the circuit is arranged to detect any cheating. The outputs of NAND gates 100, 102, and 104 are each connected to two of the three NAND gates 122, 124, and 126 in combination so that the inputs of the NAND gates 122, 124, and 126 each have inputs from two of the three NAND gates 100, 102, and 104. The outputs of each of the three NAND gates 122, 124, and 126 are connected to an input of a three input NAND gate 128. The outputs of NAND gate 128 are connected to two out of three inputs of NAND gate 130. The output 132 of flip-flop 94 is coupled to the third input of NAND gate 130. The output of NAND gate 130 is connected to inverter 134 which has its output operably connected to the cheat light 24. The output of NAND gate 128 is also connected to an inverter 138 which is connected to lead 139.

If a person cheats and presses two or more of the buttons 15, 16, or 17 simultaneously, the cheat light 24 will be actuated and the game will end. One of the NAND gates 122, 124, and 126 will have both of its inputs receiving pulses and therefore stop its pulse to NAND gate 128 which in turn will stop its pulse to the two inputs of NAND gate 130. Since line 132 has a pulse while the game is in the play mode, no pulse will be sent to inverter 134 which will cause a pulse to be applied to the set input of flip-flop 136 which actuates the cheat light 124. The game also will end since the inverter 138 will cause line 139 to be deactuated which will cause the NAND gate 140 to send an impulse to the clear input of flip-flop 94 which in effect turns the counter 20 off.

Once the game has ended because of lateness of players reaction or because the player has cheated by pressing two or more buttons simultaneously, one of the flip-flops 136 or 120 will be set whereby the cheat light 24 or the late light 22 will remain actuated to show people what the prior player did.

Once the game is disabled, the lights 11, 12, and 13 will continue to slowly blink at random in order to attract future players.

The output of the multivibrator 88 has a lead 90 connected to one of the two inputs of NAND gate 92. A second input of NAND gate 92 is a complementary output lead 96 of flip-flop 94.

The NAND gate 92 has an output 98 which leads to three NAND gates 100, 102, and 104. The second lead of each NAND gate 100, 102, and 104 is operably connected to the buttons 15, 16, and 17 respectively.

The variable frequency oscillator 44 and oscillator 34 work in the same manner as when in a play mode. When the pulse from the variable frequency oscillator 44 ends, it triggers a pulse in the monostable multivibrator 88 which pulses NAND gate 92. The NAND gate 92 has its other input connected to the complementary output 96 of flip-flop 94. The complementary output 96 generates a pulse when the circuit is in a disabled mode so that the coupled NAND gate 92 will generate a pulse through line 98 which is connected to the inputs of NAND gates 100, 102, and 104. The NAND gates 100, 102, and 104 will respond and generate an output pulse applied to the clear inputs of the flip-flops 28, 30, and 32 respectively. The light that is actuated will then be extinguished by the signal and the circuit while in its disabled mode will then be able to regenerate a new blinking light which then is again extinguished. This procedure will be repeated until the game is reset. The error check pulse generated from the multivibrator 112 will be in effect non-functional since the signal from the multivibrator 88 will always deactuate the light beforehand.

While the game is in the disabled mode, the capacitor 144 is charged up since the complementary output 96 of flip-flop 94 is then sending out a pulse which is received by the capacitor 144. The recharging of the capacitor slows down the blinking lights 11, 12, and 13 and enables the next game to start out with the slower time periods which are shortened as the game progresses. Each game then does not continue from when the other game is left off but starts over again with initially lengthened time periods. The capacitor 144 always discharges along a predictable curve and therefore each game will follow the same progression of sequentially shorter time periods.

The start switch 26 is connected to a positive potential 155 and line 158 which connects to the set input signal of input of flip-flop 94 and the clear inputs of flip-flops 136 and 120. The positive potential 155 can be six volts. Line 158 is grounded through a resistor 156. The resistor 156 can have a resistance of 1000 ohms.

The game is started by the actuation of start switch 26 which sets the flip-flop 94 so that the pulse to the complementary output 96 ceases and a pulse through the output 132 is generated. The start switch 26 also clears flip-flops 136 and 120 which deactuates the cheat light 24 and/or late light 22 respectively. The start switch 26 also resets the counter 20 through reset line 162. The start switch can be adapted to receive coinage. If so, the circuit 14 can be adapted to remain in the disabled mode when the start switch 26 is pressed but can be set to start when one of the buttons 15, 16, or 17 is first pressed to deactuate one of the lights 11, 12, or 13. This allows a player some time to get ready after he has put his coin in and has pushed the start switch 26.

The game is then played again until either the button 15, 16, or 17 is pressed too late or that two of the buttons are pressed simultaneously. This game provides for a person to test his reflexes and coordination and to test his skills as the game gets progressively tougher since the time when he is able to respond is successively shortened.

Reasonable variations and modifications are possible within the scope of the disclosure and drawings without departing from the spirit and scope of the invention which is defined in the appended claims.

The embodiments of the invention in which an exclusive property or privilege is claimed are defined as follows:

1. An electrically operated game apparatus comprising:

a plurality of visual stimuli indicators;

a corresponding number of manually operable switch means;

means for actuating the stimuli indicators in an indeterminate random sequence for predetermined periods of time;

means in the electrical circuit operably coupling each stimuli indicator with a switch means for electrically deactuating a stimuli indicator when a corresponding switch means is operated;

means in the electrical circuit for disabling at least a portion of the electrical circuit for ending the game played with the apparatus in the event that a stimuli indicator remains actuated at the end of a predetermined period of time;

manually operative means for resetting the disabling means and for restarting the game apparatus; and means operably coupling the switch means with the disabling means for actuating the disabling means when two or more switch means are simultaneously operated.

2. A game apparatus according to claim 1 and further comprising:

late indicating means in the electrical circuit providing a first signal when a stimuli indicator remains actuated at the end of the predetermined time period from when it is actuated.

3. A game apparatus according to claim 2 and further comprising:

means coupling said late indicating means to said disabling means for preventing operation of the late indicating means more than once prior to actuation of the resetting means.

4. A game apparatus according to claim 3 and further comprising:

means coupled to said switch means providing a second signal only when two or more switch means are simultaneously operated.

5. A game apparatus according to claim 4 wherein the disabling means is coupled to the second signal providing means to prevent operation of the second signal subsequent to operation of the disabling means and prior to actuation of the manually operative resetting means.

6. A game apparatus according to claim 4 further comprising:

means in the electrical circuit for counting the successive number of times the stimuli indicators are deactuated by the corresponding switch means before operation of the disabling means; and wherein the electrical circuit disabled portion is the counting means; and means operable coupling the manually operative means with the counting means for resetting the counting means when the manually operative means is actuated.

7. A game apparatus according to claim 4 wherein the plurality of stimuli indicators, the first signal, and the second signal are lights which are illuminated when actuated.

8. A game apparatus according to claim 7 and further comprising means for gradually shortening the predetermined time period when each successive stimuli indicator is actuated.

9. An apparatus according to claim 1 wherein the means for actuating the stimuli indicators in a random sequence for predetermined periods of time includes:

a short pulse generating means;

a gating means for each stimuli indicator operable upon receipt of at least two simultaneous pulses;

a means for sequentially applying the pulses from the short pulse generating means to each of the gating means in a random sequence;

means for generating a timing pulse;

means for applying the timing pulse to each of the gating means simultaneously with the application of the pulse from the pulse generating means to one of the gating means;

means for preventing actuation of a second stimuli indicator when another stimuli indicator is actuated.

10. An apparatus according to claim 9 wherein the disabling means includes:

means for generating a pulse of predetermined length;

the means for generating the timing pulse being operably connected to the means for generating a pulse of predetermined length and responsive thereto such that the timing pulse is generated by the start of a pulse of predetermined length;

a triggering means operably connected to the means for generating the pulse of predetermined length for triggering an error check pulse after the start of the said pulse of predetermined length but before the beginning of the successive pulse of predetermined length;

means for applying the error check pulse to the late indicating means so as to actuate the late indicating means if a stimuli indicator is actuated; and means for applying the error check pulse to the disabling means to actuate the same if a stimuli indicator remains actuated.

11. A game apparatus according to claim 10 further comprising:

late indicating means in the electrical circuit for providing a first signal when a stimuli indicator remains actuated at the end of the predetermined time period from when it is actuated;

means coupled to the switch means providing a second signal when two or more switch means are simultaneously operated;

means operably coupling the switch means with the disabling means for actuating the disabling means when two or more switch means are simultaneously operated; and means coupling the disabling means with the switch means for deactuating an actuated stimuli indicator prior to the triggering of the error check pulse when the disabling means is actuated.

12. A game apparatus according to claim 1 wherein the switch means are spring biased buttons normally in an open position and pushed to a closed position, the switch means deactuates the stimuli indicator when in a closed position.

13. A game apparatus according to claim 1 further comprising:

means in the electrical circuit for counting the successive number of times the stimuli indicators are deactuated by the corresponding switch means before operation of the disabling means; and wherein the electrical circuit disabled portion is the counting means; and means operably coupling the manually operative means with the counting means for resetting the counting means when the manually operable resetting means is actuated.

14. An electrically operated game apparatus comprising:

a plurality of visual stimuli indicators;

a corresponding number of manually operable switch means;

an electrical circuit including means for actuating the stimuli indicators in a random indeterminate sequence for predetermined periods of time;

means in the electrical circuit operably coupling each stimuli indicator with a switch means for deactuating a stimuli indicator when a corresponding switch means is operated; and means providing a signal only when two or more switch means are simultaneously operated.

15. An electrically operated game apparatus comprising:

a plurality of stimuli indicators;

a corresponding number of manually operable switch means;

an electrical circuit including means for actuating the stimuli indicators in a random sequence for predetermined periods of time;

means in the electrical circuit operably coupling each stimuli indicator with a switch means for electrically deactuating a stimuli indicator when a corresponding switch means is operated; and means for gradually shortening the predetermined period of time when each successive stimuli indicator is actuated.

16. An electrically operated game apparatus comprising:

a plurality of visual stimuli indicators;

a number of manually operable switch means corresponding to the visual stimuli indicators;

means for actuating the stimuli indicators in an indeterminate random sequence for predetermined periods of time including: a short pulse generating means, a gating means for stimuli indicators operable upon receipt of at least two simultaneous pulses, a means for sequentially applying the pulses from the short pulse generating means to each of the gating means in a random sequence, means for generating a timing pulse, means for applying the timing pulse to each of the gating means simultaneously with the application of the pulse from the pulse generating means to one of the gating means, means for preventing actuation of a second stimuli indicator when another stimuli indicator is actuated;

means in the electrical circuit operably coupling each stimuli indicator with one of the switch means for electrically deactuating a stimuli indicator when a corresponding switch means is operated;

means in the electrical circuit for disabling at least a portion of the electrical circuit for ending the game played with the apparatus in the event that a stimuli indicator remains actuated at the end of a predetermined period of time, the disabling means including: means for generating a pulse of predetermined length; the means for generating the timing pulse being operably connected to the means for generating a pulse of predetermined length such that the timing pulse is generated by the start of a predetermined pulse, a triggering means operably connected to the means for generating the pulse of predetermined length for triggering an error check pulse after the start of the said pulse of predetermined length but before the beginning of the successive pulse of predetermined length, means for applying the error check pulse to the late indicating means so as to actuate the late indicating means if a stimuli indicator is actuated, and means for applying the error check pulse to the disabling means to actuate the same if a stimuli indicator remains actuated; and manually operative means for resetting the disabling means and for restarting the game apparatus.

17. An apparatus according to claim 16 wherein the means for shortening the time period of successive pulses include an input voltage connected to the means for generating the pulse of predetermined length, the frequency of the pulses from the pulse generating means being dependent on the input voltage; and means for gradually changing the input voltage so that the frequency of the pulses is gradually increased and the period of time between the beginning of the pulse of predetermined length and the generation of the error check pulse is decreased.

18. An apparatus according to claim 17 wherein the gradual changing means includes a charged capacitor operably connected to the input voltage of the generating means, and means for slowly discharging the capacitor so as to gradually lower the voltage of the input voltage.

19. An apparatus according to claim 18 and further including means for recharging the capacitor after the disabling means disables the portion of the electrical circuit and until the reset means resets the disabling means so that pulses of predetermined length are again lengthened at the beginning of the game and become successively shorter.

* * * * *